United States Patent [19]

Alexeff

[11] 3,962,762

[45] June 15, 1976

[54] METHOD OF MAKING A FABRIC SPLICE

[75] Inventor: Alexander V. Alexeff, Cleveland, Ohio

[73] Assignee: Alexeff-Snyder Enterprises, Inc., Cleveland, Ohio

[22] Filed: Nov. 11, 1974

[21] Appl. No.: 522,515

Related U.S. Application Data

[62] Division of Ser. No. 376,537, July 5, 1973, Pat. No. 3,885,596.

[52] U.S. Cl. ..... 28/72 R; 242/58.5

[51] Int. Cl.[2] ..... B65H 69/06; D03D 23/00

[58] Field of Search ..... 28/72 R; 139/28; 242/58.1, 58.5; 245/10

[56] References Cited

UNITED STATES PATENTS

| | | | |
|---|---|---|---|
| 1,776,220 | 9/1930 | Gehret | 139/28 |
| 1,812,506 | 6/1931 | Willits | 139/28 |
| 2,825,366 | 3/1958 | Freeman, Jr. | 139/28 |
| 2,940,506 | 6/1960 | McKee et al. | 242/58.1 X |
| 3,238,594 | 3/1966 | Schuster | 28/72 R |
| 3,283,788 | 11/1966 | Bottomley et al. | 139/28 |
| 3,622,415 | 11/1971 | Kunsman | 28/72 R X |

FOREIGN PATENTS OR APPLICATIONS

| | | | |
|---|---|---|---|
| 1,035,932 | 7/1966 | United Kingdom | 139/28 |

*Primary Examiner*—Robert R. Mackey

*Attorney, Agent, or Firm*—Donnelly, Maky, Renner & Otto

[57] ABSTRACT

Overlapped fabric end portions define a fabric double layer. A plurality of partial loops are formed in the double layer extending alternately in opposite directions transversely of the double layer to define a transverse row of loops. Elongated substantially rigid rod means extends through the row of loops for splicing the fabric end portions together.

11 Claims, 23 Drawing Figures

METHOD OF MAKING A FABRIC SPLICE

This is a division, of application Ser. No. 376,537 filed July 5, 1973 now U.S. Pat. No. 3,885,596, granted May 27, 1975.

BACKGROUND OF THE INVENTION

This application pertains to the art of fabric splicing, and to an improved method for making a fabric splice.

Fabric is commonly processed by moving it in a flat condition through a treatment apparatus at high velocity. A leading end of a new fabric roll is commonly spliced to the tail end of a roll being processed in order to provide a continuous operation.

Fabric used to manufacture vehicle tires is commonly moved under tension through an oven for stress relieving the fabric yarns. Such fabric is tensioned as high as 30,000 pounds and run through an oven at a temperature close to 500°F. Fabric of rayon, nylon, polyester and other materials is commonly treated in this manner. The fabric commonly runs through the oven at a rate of around 120 yards per minute. In order to provide a continuous operation, approximately 250–300 yards of fabric are stored in a storage accumulator ahead of the oven. When the tail end of a fabric roll is spliced to the leading end of a new fabric roll, the fabric in the storage accumulator is fed through the oven. Stoppage of the fabric in the oven for a long period of time would ruin a section of the fabric and it would be necessary to rethread a fabric through the entire treatment apparatus.

Leading and tailing end portions of the fabric are commonly spliced together by the use of a high temperature and high pressure vulcanizing press. The leading and tail end portions of fabric are overlapped with unvulcanized rubber therebetween. The press closes to subject the overlapped end portions and rubber to high pressure and temperature for vulcanizing the rubber and bonding it to the fabric. Making such a fabric splic requires approximately 30–40 seconds to complete, not counting preparation time. Certain fabrics, such as polyester, do not bond well to the rubber. Under the high tensions and temperatures encountered, vulcanized rubber splices often have a tendency to fail.

Fabric splices of the type described are also commonly made by the use of multi-needle sewing machines. This requires a large number of stitches, and preparation for the sewing operation takes considerable time.

In prior splicing procedures of the type described, a large amount of extra fabric must be stored in the storage accumulator to insure sufficient fabric for continuous travel through the oven while the splice is being made. Any delay in making the splice will require shutting down the rolls pulling the fabric through the oven until the splice is completed. This will often ruin a large section of fabric in the oven and may even require shutting down the apparatus in order to rethread the fabric.

It would be desirable to have a way of making a fabric splice in a very short period of time while maintaining high strength for the tension forces encountered.

SUMMARY OF THE INVENTION

A fabric splice of the type described is made by overlapping the leading and tail fabric end portions to define a fabric double layer. A plurality of partial loops are formed in the double layer extending alternately in opposite directions transversely of the double layer to define a row of loops. Substantially rigid elongated rod means extends through the row of loops for splicing the fabric end portions together.

In the preferred arrangement, a plurality of loop rows are provided, and elongated substantially rigid rod means extend through each loop row.

For wide fabrics, the substantially rigid rod means may be inserted into the loop rows from both side edges of the double layer so that the rods will overlap at their inner end portions in each loop row.

The improved apparatus constructed in accordance with the present invention includes clamping means for transversely clamping the fabric double layer in longitudinally-spaced locations. The apparatus includes loop forming means on opposite sides of the fabric double layer intermediate the clamping means for forming a plurality of partial loops in the double layer extending alternately in opposite directions transversely and longitudinally of the double layer to form a plurality of transversely extending loop rows. In a preferred arangement, the apparatus further includes reciprocating rod inserting means for inserting elongated substantially rigid rods through the loops.

In accordance with one arrangement, the rod inserting means includes a guide support for supporting a plurality of rods in substantially parallel spaced-apart relationship. The rod inserting means includes a pusher reciprocable toward and away from the fabric double layer for pushing the rods longitudinally along the guide support into the loop rows. In one arrangement, the guide support includes a plurality of spaced-apart elongated rod receiving grooves and the pusher includes a plurality of spaced-apart pusher fingers recieved in the grooves. Preferably, rod guide means is provided above the guide support for holding the rods in the grooves as the pusher moves the rods longitudinally relative to the guide support. The guide means may comprise a plurality of spaced-apart plates pivotally mounted above the guide support on axes extending substantially parallel to the longitudinal axis of the fabric. The plates have bottom edges positioned closely above the grooves.

The improved apparatus includes opposed platens positioned on opposite sides of the fabric double layer. Each platen includes a plurality of spaced-apart pairs of spaced-apart partial loop forming fingers. At least one of the platens is movable toward the other to overlap the fingers and form loops in the fabric double layer.

In accordance with a preferred arrangement, the platens include fabric holding bars for transversely holding leading and tail end portions of fabric while the one platen moves toward the other to overlap the fabric end portions in a fabric double layer. The fabric holding bars are selectively movable outward and inward relative to their respective platens so that a leading edge of a new fabric roll may be held to one of the platens in preparation for making a fabric splice when the tail end of a fabric roll being processed is reached.

A further object of the present invention is to provide an improved method for making a fabric splice.

Another object of the invention is to provide a method by which a fabric splice which can be made in an extremely short period of time.

An additional object of the present invention is to provide a method for making a fabric splice which is capable of withstanding very high tension.

A further object of the present invention is to provide an improved method for making a fabric splice in a highly simplified manner.

Other objects and advantages of the present invention will become apparent as the following description proceeds.

To the accomplishment of the foregoing and related ends, the invention then, comprises the features hereinafter fully described and particularly pointed out in the claims, the following description and the annexed drawings setting forth in detail certain illustrative embodiments of the invention, these being indicative, however, of but a few of the various ways in which the principle of the invention may be employed.

DESCRIPTION OF THE PREFERRED EMBODIMENT

Figure 1:
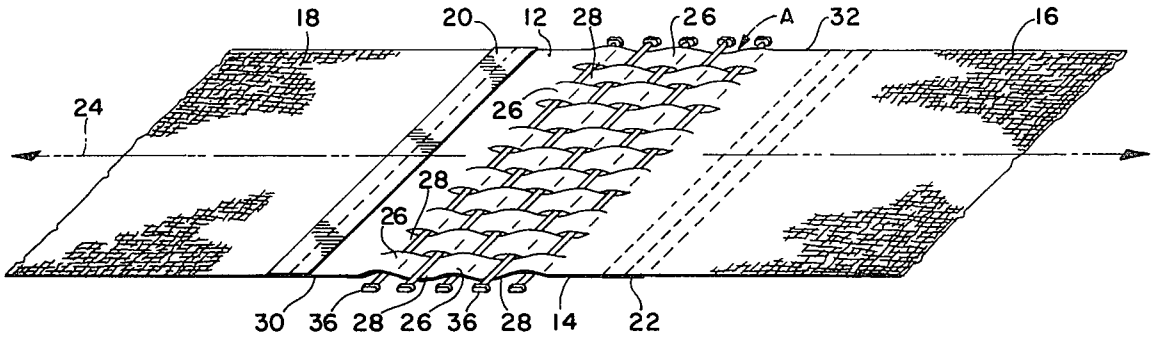
FIG. 1 is a perspective illustration of a fabric splice made in accordance with the present invention.

Referring now to the drawings, wherein the showings are for purposes of illustrating a preferred embodiment of the invention only and not for purposes of limiting same, FIG. 1 shows a fabric splice A in a fabric double layer defined by contacting overlapped leading and tail fabric end portions 12 and 14 of flat woven fabrics 16 and 18. Each end portion 12 and 14 may have a tabby

20 and 22 in the form of tightly woven yarns for preventing unravelling of the yarns. Fabric double layer A has a longitudinal axis 24. Fabric end portions 12 and 14 overlap one another to define a substantially horizontal lapping plane therebetween.

Fabric double layer A has a plurality of parital loops 26 and 28 extending alternately in opposite directions transversely of longitudinal axis 24 between opposite side edges 30 and 32 of double fabric layer A. In the preferred arrangement, loops 26 and 28 also extend alternately in opposite directions parallel to longitudinal axis 24. Thus, partial loops 26 and 28 define a plurality of loop rows extending transversely of longitudinal axis 24, with the loop rows being spaced-apart from one another in a direction parallel to longitudinal axis 24. Each loop row receives an elongated substantially rigid rod 36. Rods 36 may be formed with any suitable material, such as substantially rigid nylon or other synthetic plastic material. Rods 36 extend alternately under and over partial loops 26 and 28 to provide a joint which looks like a laced splice. When tension is applied to the fabric, the laced splice becomes tightly woven with rods 36 substantially pressing against one another. In a preferred arrangement, each partial loop row terminates at opposite side edges 30 and 32 with partial loops extending in a common direction. Thus, the left hand partial loop row in FIG. 1 terminates at side edges 30 and 32 with partial loops 26 extending in a common direction. The next partial loop row terminates at side edges 30 and 32 with loops 28 extending in an opposite direction. This preferred arrangement enables a splice to develop maximum strength with minimum twisting of rods 36.

With a splice of the type described, it has been found possible to develop fabric tensions in the splice almost equal to the ultimate design strength of the fabric material itself. Rods 36 may be inserted from only one side edge of double layer A or from both side edges thereof. For wide fabrics, it is desirable to insert rods 36 from both side edges 30 and 32 of double layer A. With such an arrangement, each rod 36 will have a length slightly greater than one-half the width of double layer A. The inner end portions of the rods will then overlap in each loop row near central longitudinal axis 24.

Figure 2:
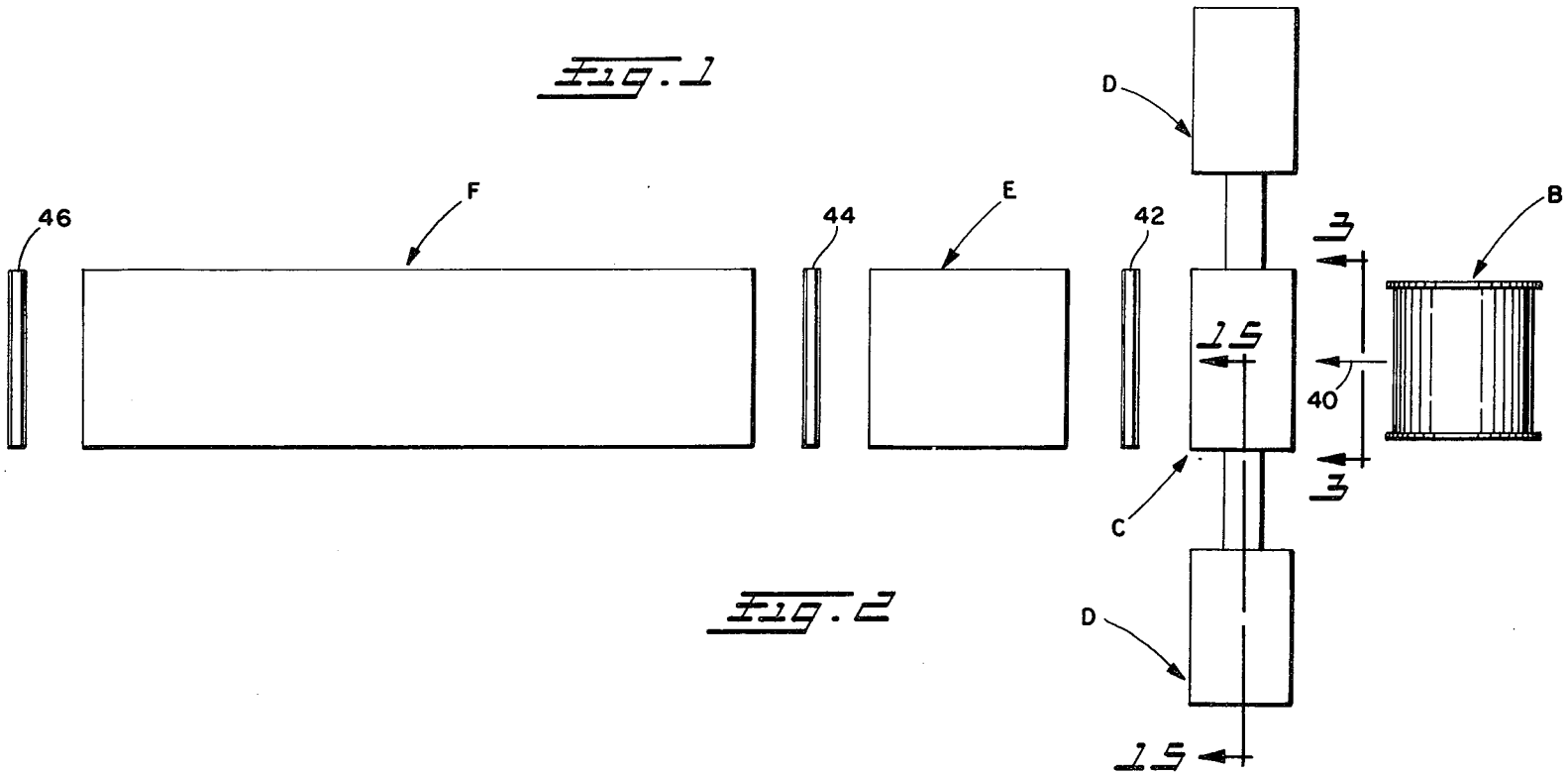
FIG. 2 is a diagrammatic plan view of a fabric processing apparatus having the improved splicing apparatus of the present invention incorporated therein.
Figure 6:
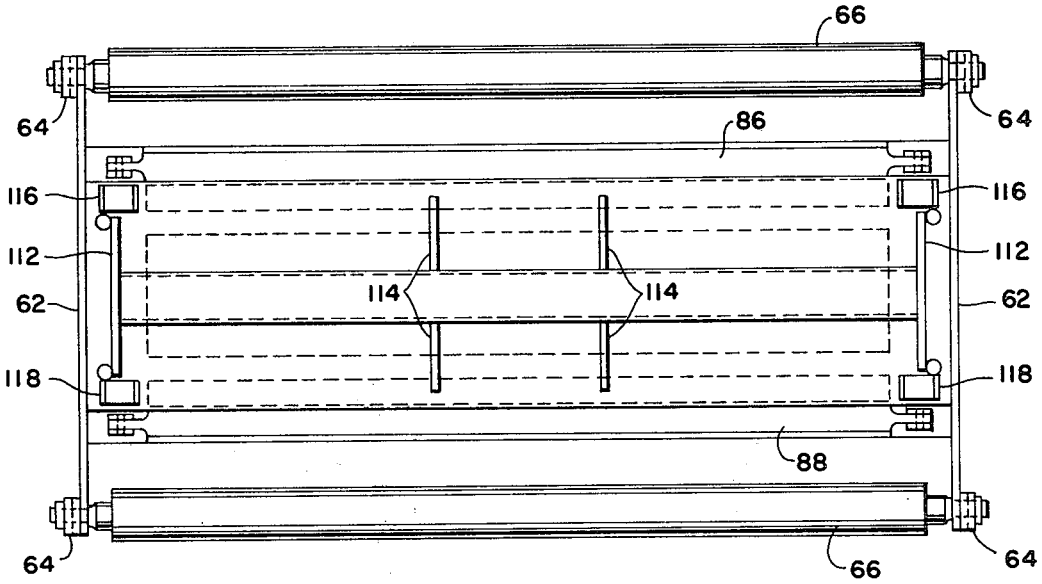
FIG. 6 is a top plan view looking generally in the direction of arrows 6—6 of FIG. 3.
Figure 3:
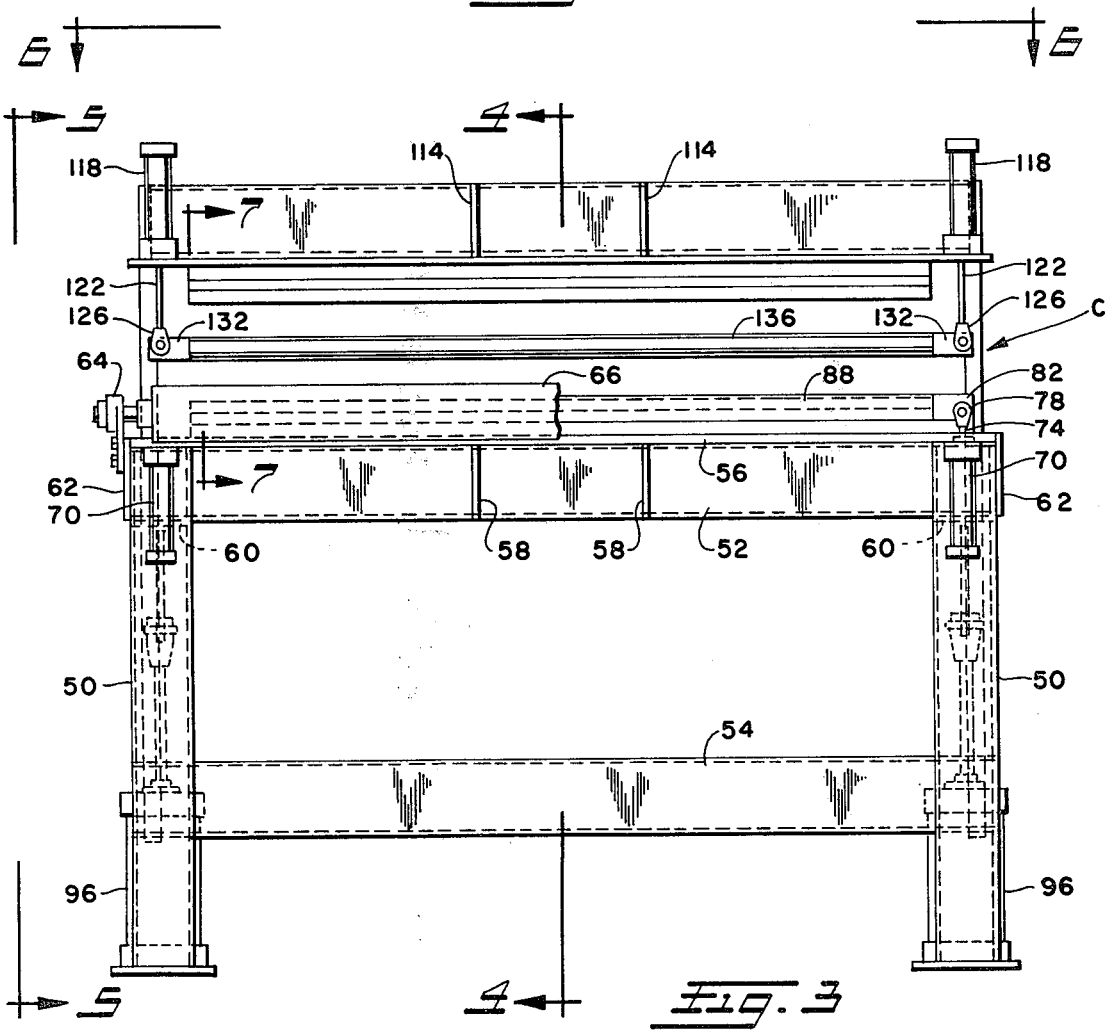
FIG. 3 is an elevational view looking generally in the direction of arrows 3—3 of FIG. 2.

FIG. 2 is a diagrammatic plan view of a fabric processing apparatus for processing a roll of fabric B which travels in a flat condition through the apparatus in the direction of arrow 40. The fabric moves through an improved splicing apparatus C including automatic rod inserting devices D constructed in accordance with the present invention. The fabric is fed by rolls 42 into a storage accumulator E. The fabric then travels through idler tensioning rolls 44 into an oven F and is pulled therethrough by rolls 46. Tensioning rolls 44 produce a drag on the fabric so that it is under considerable tension as it is pulled through oven F by rolls 46. Rolls 42 feed fabric into storage accumulator E at a faster rate than it is pulled therefrom by rolls 46. The speeds of rolls 42 and 46 are adjusted so that sufficient yardage of material will be in storage accumulator E when the tail end of fabric B approaches splicer C so that a splice can be made while rolls 46 continue to pull stored material from storage accumulator E.

In accordance with one arrangement, splicer C has a supporting frame including a plurality of spaced-apart upright legs 50. Pairs of spaced-apart upper and lower box beams 52 and 54 are bolted, welded or otherwise secured to the inner surfaces of legs 50. A flat plate member 56 is secured to the upper surfaces of upper beams 52. Plate 56 extends outwardly of beams 52 and may be braced by spacedapart triangular bracing members 58 welded to the outer surfaces of beams 52 and to the undersurface of plate 56.

Figure 4:
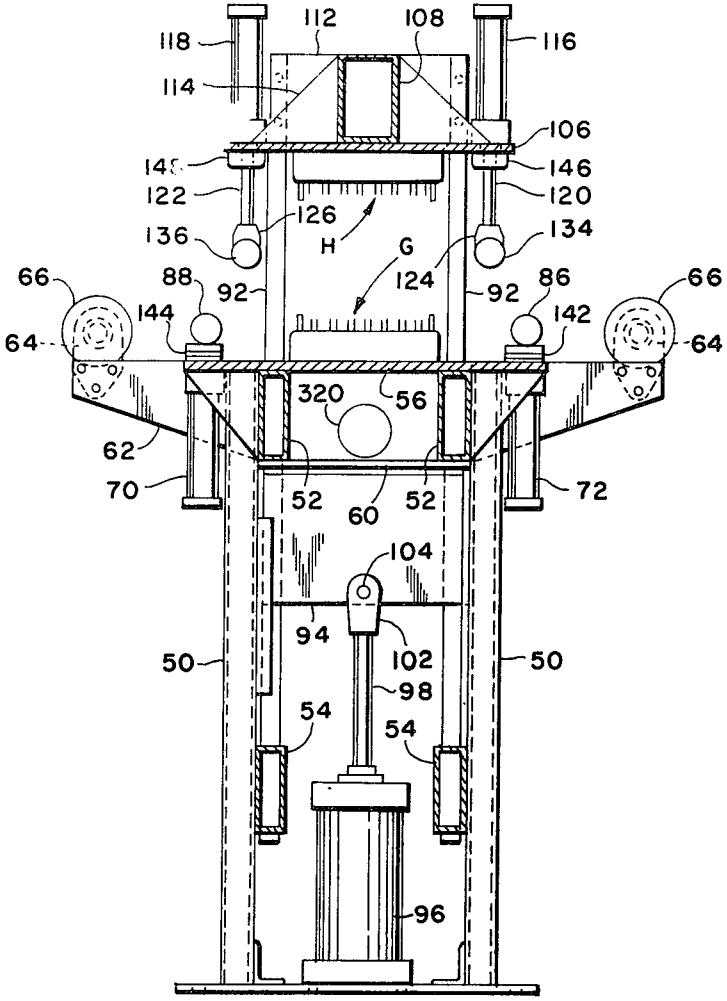
FIG. 4 is a cross-sectional elevational view looking generally in the direction of arrows 4—4 of FIG. 3.
Figure 5:
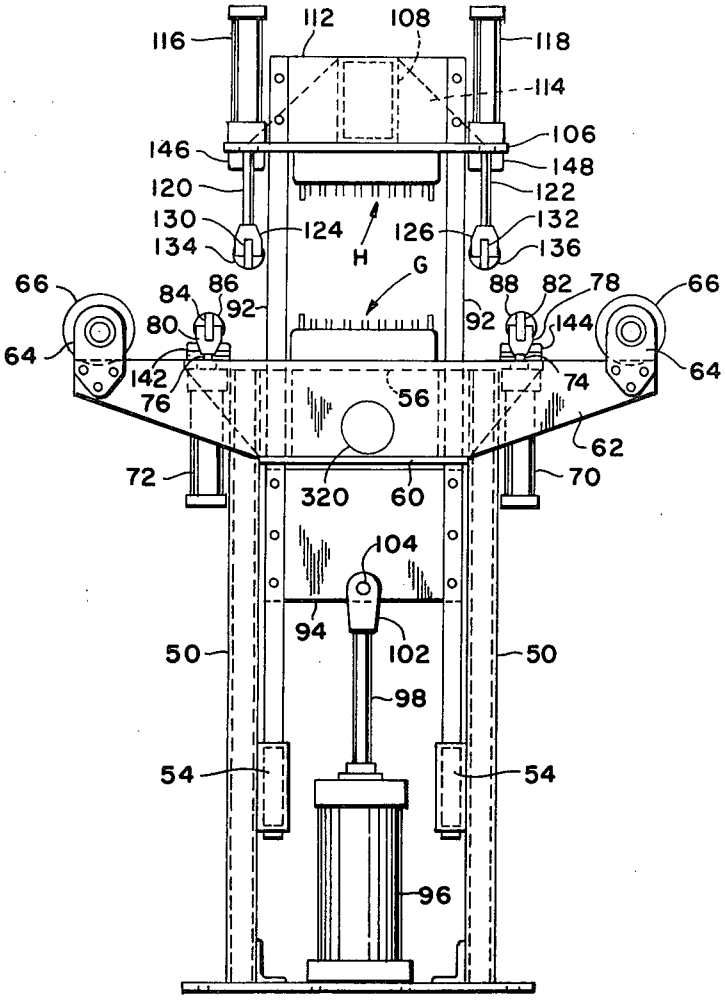
FIG. 5 is an end elevational view looking generally in the direction of arrows 5—5 of FIG. 3.

Bottom plates 60 are welded to the undersurfaces of upper beams 52 and span each end pair of legs 50. A generally inverted trapezoidal-shaped roll supporting plate 62 is welded to the opposite ends of upper beams 52 and bottom plates 60. Roll support plates 62 have bearing assemblies 64 bolted thereto. Elongated rolls 66 are rotatably journaled in bearings 64. A bottom loop forming platen G having upwardly extending loop forming fingers thereon is positioned on plate 56. (see FIGS. 4 and 5).

Pairs of hydraulic or pheumatic cylinders 70 and 72 are secured to the undersurface of plate 56 adjacent the corners thereof. Cylinders 70 and 72 have rods 74 and 76 extending through suitable holes in plate 56. Each rod 74 and 76 has a bifurcated member 78 and 80 secured thereto for receiving a flattened portion 82 or 84 on elongated cylindrical fabric holding bars 86 and 88. Suitable pins extend through bifurcated members 78 and 80, and flattened portions 82 and 84, for securing elongated fabric holding bars 86 and 88 to cylinder rods 74 and 76.

Upper and lower box beams 52 and 54 have vertically-aligned holes therethrough for slidably receiving four vertically positioned cylindrical rods 92. A pair of rectangular plates 94 are bolted to each pair of rods 92 beneath bottom plates 60. A pair of hydraulic or pneumatic cylinders 96 have cylinder rods 98 connected with plates 94 by means of a bifurcated member 102 receiving the bottom edge portion of each plate 94 and connected thereto as by pins 104. The upper end portions of rods 92 extend through suitable holes in rectangular plate member 106. A centrally located box beam 108 is welded or otherwise secured to plate member 106. Rectangular end plates 112 are welded to the ends of box beam 108 and to the ends of plate 106. The upper end portions of rods 92 are bolted to rectangular end plates 112. Triangular reinforcing plates 114 are welded to the outer surfaces of box beam 108 and to the upper surface of plate 106. An upper platen H having downwardly extending loop forming fingers thereon is secured to plate 106.

Hydraulic or pneumatic cylinders 116 and 118 are secured to the upper surface of plate 106 adjacent the four corners thereof. Cylinders 116 and 118 have rods 120 and 122 extending through suitable holes in plate member 106. Rods 120 and 122 have bifurcated members 124 and 126 receiving flat end portions 130 and 132 on elongated cylindrical fabric holding bars 134 and 136. Suitable pins extend through bifurcated members 124 and 126, and flattened portions 130 and 132, for holding elongated fabric holding bars 134 and 136 to cylinder rods 120 and 122.

Elongated strips of rubber or other material may be secured to the upwardly facing surface of plate 56 and to the downwardly facing surface of plate 106 to provide holding surfaces for cooperation with holding bars 86, 88, 134 and 136. Such holding strips are generally indicated by numberals 142, 144, 146 and 148 (see FIG. 4).

In the arrangement shown and described, each pair of cylinders 70, 72, 116 and 118 are connected for selective energization so that each fabric holding bar 86, 88, 134 and 136 can be individually extended or retracted. Upper platen H is shown in its maximum upward position. Selective energization of double acting cylinders 96 will lower platen H for cooperation with lower platen G.

Figure 7:
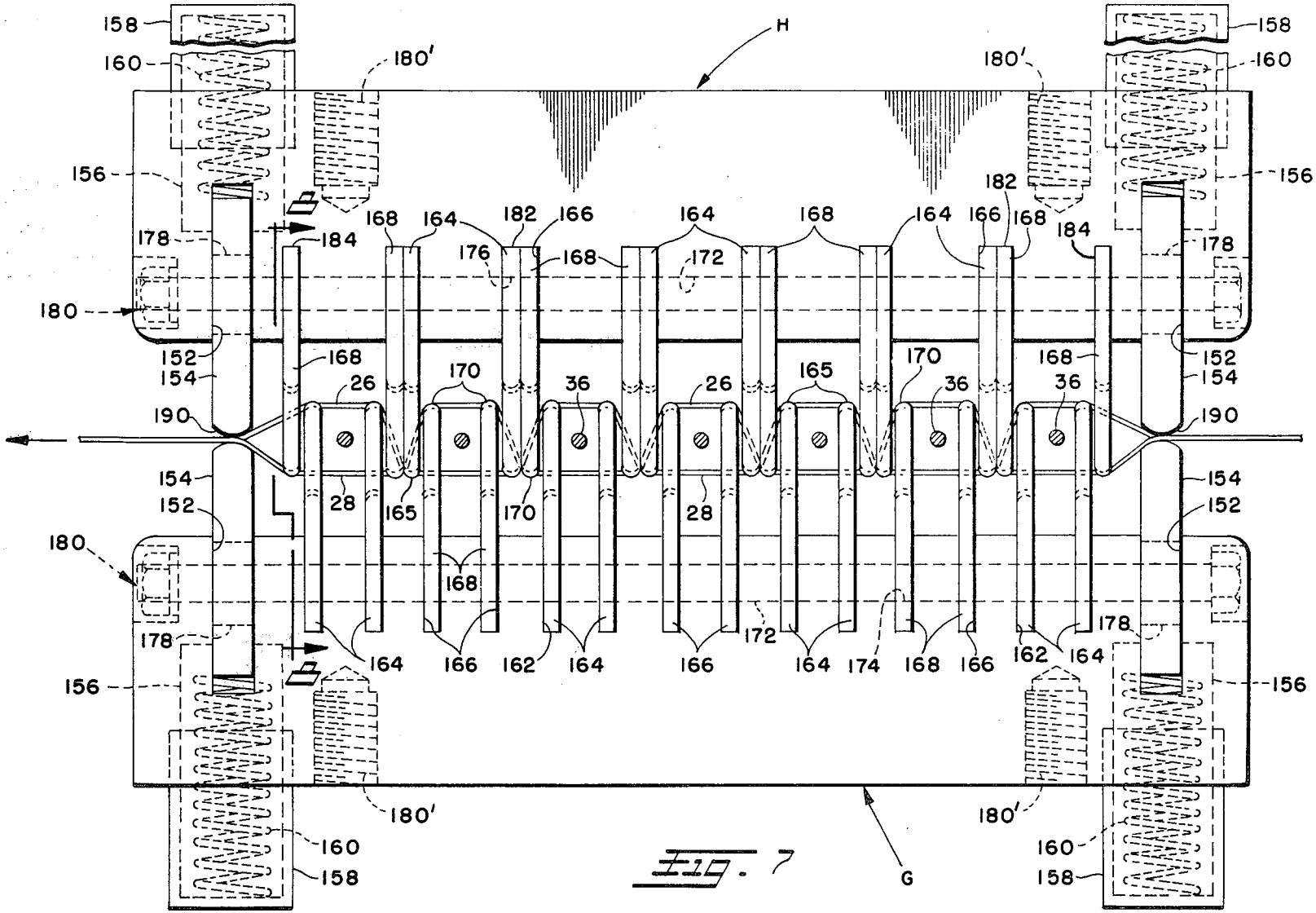
FIG. 7 is a partial cross-sectional elevational view looking generally in the direction of arrows 7—7 of FIG. 3.

As shown in FIG. 7, each platen G and H has a pair of transversely extending longitudinally-spaced slots 152 therein receiving elongated transversely extending flat plate members 154 defining fabric clamping means. Platens G and H have threaded bores 156 intersecting slots 152 and receiving cartridges 158 having coil springs 160 bearing against fabric clamps 154 to yieldably bias fabric clamps 154 outwardly relative to slots 152. Lower platen G has additional spaced-apart alternate pairs of transverse slots 162 receiving elongated flat spaced-apart finger plates 164. Each pair of finger plates 164 has a plurality of transversely spaced-apart fingers 165 thereon. The fingers on each pair of finger plates 164 are longitudinally aligned with one another. Platen G includes a plurality of additional pairs of spaced-apart slots 166 receiving spaced-apart elongated flat finger plates 168. Finger plates 168 have fingers 170 thereon which are transversely spacedapart. Fingers 170 on each pair of plates 168 are longitudinally aligned with one another and are staggered relative to fingers 165 on plates 164. That is, fingers 165 are in alignment with the spaces between fingers 170, and fingers 170 are in alignment with the spaces between fingers 165. Elongated longitudinal bores 172 are formed through platen G. Finger plates 164 and 168 have holes 174 and 176 therethrough in alignment with bores 172. Clamp members 154 have vertically elongated holes 178 therethrough in alignment with bores 172. Each bore 172 receives a bolt of a bolt and nut assembly 180 which holds plates 164 and 168 to platen G. The bolt extends through vertically elongated holes 178 in clamps 154 so that clamps 154 can move relative to the bolt. Platens G and H include tapped holes 180 for bolting the platens to plates 56 and 106.

Platen H has a plurality of longitudinally-spaced transversely extending slots 182 aligned between pairs of slots 162 and 166 on platen G. End slots 184 have a width for receiving one finger plate, while slots 182 have a width for receiving two finger plates. Pairs of finger plates 164 and 168 are positioned in each slot 182 so that adjacent slots have adjacent pairs of finger plates 164 or 168 for cooperation with one another. Each pair of plates 164 and 168 on upper platen H are spaced-apart a greater distance than similar pairs of plates on lower platen G. Thus, pairs of plates 164 or 168 on lower platen G are respectively receivable between pairs of plates 168 or 164 on upper platen H.

Clamp plates 154 preferably have transversely arcuate clamping edges as shown at 190 in FIG. 7. In the open position of the platens, edges 190 of the opposed clamp plates normally extend outwardly beyond the ends of the fingers on their respective platens. When platen H is moved downwardly toward platen G, clamp members 154 first clamp the double layer of fabric therebetween. Further movement of platen H toward platen G causes overlapping of the fingers on platens G and H until the final position shown in FIG. 7 is reached. Each pair of plattes 164 and 168 on upper platen H are spaced-apart a greater distance than similar pairs of plates on lower platen G. Thus, pairs of plates 164 or 168 on lower platen G are respectively receivable between pairs of plates 168 or 164 on upper platen H. The fingers on finger plates 164 and 168 on lower platen H form upwardly extending partial loops 26 in the fabric double layer. Partial loops 26 formed by each pair of plates 164 are transversely spaced from partial loops 26 formed by each pair of plates 168 on lower platen G. Each pair of finger bars 168 on upper platen G, between which pairs of plates 164 on lower platen G are received, form downwardly extending partial loops 28 transversely-spaced from the upwardly extending partial loops formed by plates 164 on lower platen G. Thus, each pair of plates 164 forms partial loops 28 which are transversely-spaced with respect to partial loops 26 formed by plates 168 on lower platen G and with respect to partial loops 28 formed by plates 168 on upper platen H. Partial loops 26 formed by pairs of plates 164 on lower platen G are in longitudinal alignment with oppositely extending partial loops 28 formed by pairs of plates 164 on upper platen H. With the fabric double layer separated into loop rows, elongated rigid rods 36 are inserted into the loop rows. Platen H is then moved upward relative to platen G. Rods 36 will then securely hold the overlapped end portions of the fabric tightly together.

Figure 8:
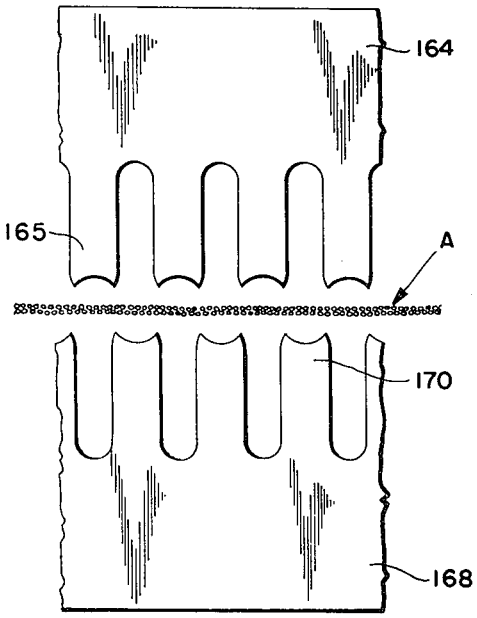
FIG. 8 is a partial cross-sectional elevational view looking generally in the direction of arrows 8—8 of FIG. 7.
Figure 9:
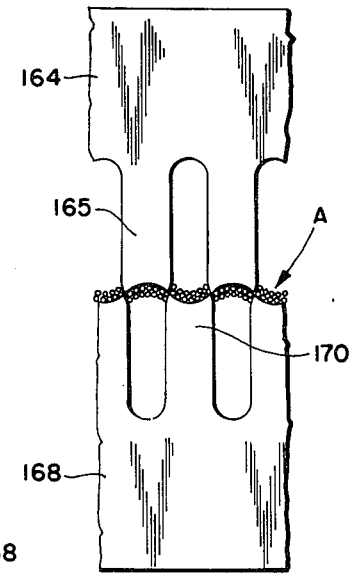
FIG. 9 is a view similar to FIG. 8 and showing another position of loop forming fingers.

FIG. 8 shows how fingers 170 on finger plates 168 are transversely staggered relative to fingers 165 on finger plates 164. As shown, fingers 170 are in longitudinal alignment with the spaces between fingers 165 and vice versa. FIG. 9 shows how the fingers trap a plurality of warp yarns in fabric double layer A to begin forcing fabric into the spaces between opposed fingers to form partial loops 26 and 28 in double layer A.

Figure 10:
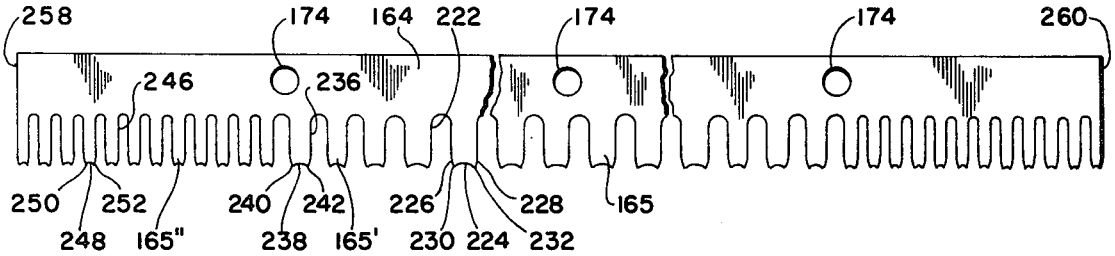
FIG. 10 is an elevational view of one loop forming finger plate.
Figure 11:
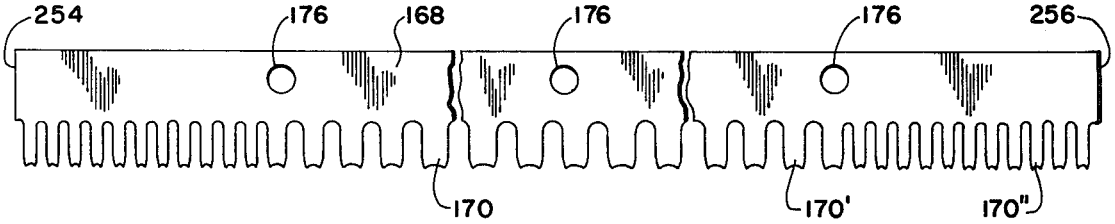
FIG. 11 is an elevational view of another loop forming finger plate.

Finger plates 164 and 168 are shown in detail in FIGS. 10 and 11. Finger plate 164 has a plurality of spaced-apart central partial loop forming fingers 165 extending over the major length thereof. Obviously, any number of fingers may be provided depending upon the width of the fabric and the desired width of the partial loops to be formed. In the arrangement shown, there are a total of 56 central fingers 165. Fingers 165 have a width of 9/32 inch and are spaced-apart by spaces 222 having a width of 7/32 inch. Fingers 165 have concave terminal ends 224 curved on a radius of 5/32 inch. fingers 165 are smoothly rounded inwardly as at 226 and 228 so that concave portion 224 extends across peaks 230 and 232 which are spaced-apart ¼ inch. Thus, inwardly curved portions 226 and 228 extend inwardly from the side edges of fingers 165 to peaks 230 and 232 a distance of 1/64 inch.

A plurality of smaller intermediate fingers 165' are provided outwardly of fingers 165. In the arrangement shown, there are a total of six intermediate fingers 165', with three being at each side of fingers 165. Fingers 165' have a width of 7/32 inch and are separated by spaces 236 having a width of 5/32 inch. Fingers 165' have concave terminal ends 238 curved on a radius of ⅛ inch. Fingers 165' are also smoothly curved inwardly toward peaks 240 and 242 which are spaced-apart 3/16 inch. Thus, fingers 165' are also curved inwardly from the side edges thereof toward peaks 240 and 242 a distance of 1/64 inch.

A plurality of smaller terminal fingers 165'' are provided on the opposite end portions of finger plate 164. A total of 24 terminal fingers 165'' are shown, with twelve at each opposite end portion of finger plate 164. Obviously, any number of the various fingers may be provided. Fingers 165'' have a width of 5/32 inch and are separated by spaces 246 having a width of 3/32 inch. Concave terminal end portions 248 of fingers 165' are curved on a radius of 3/32 inch. Concave terminal end portions have peaks 250 and 252 spaced-apart ⅛ inch. Thus, fingers 165'' also curve inwardly toward peaks 250 and 252 over a distance of 1/64 inch from each opposite side edge of fingers 165''.

Figure 12:
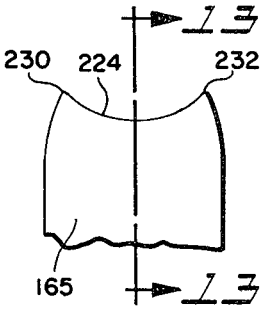
FIG. 12 is an enlarged elevational view of a single finger of a finger plate.
Figure 13:
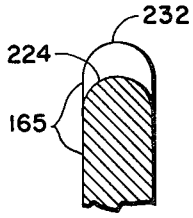
FIG. 13 is a cross-sectional elevational view looking generally in the direction of arrows 13—13 of FIG. 12.

Finger plate 168 also has a plurality of central fingers 170. In the arrangement shown, there would be a total of 56 central fingers 170. Fingers 170 are dimensioned and spaced in the same manner as described with respect to fingers 165. Finger plate 168 also has a plurality of intermediate fingers 170' which are dimensioned and spaced in the same manner as fingers 165'. In the arrangement shown, there are also a total of six intermediate fingers 170' with three at each opposite side of central fingers 170. Finger plate 168 has a plurality of terminal fingers 170'' dimensioned and spaced in the same manner as fingers 165''. However, there are a total of only 22 terminal fingers 170'', with eleven at each side end portion of finger plate 168. In addition, the first terminal finger 170' is spaced inwardly from opposite end edges 254 and 256. The first of fingers 170' are spaced inward from terminal end edges 254 and 256 by distance of 3/32 inch. On the other hand, fingers 165'' start flush with opposite end edges 258 and 260 of finger plate 164. As shown in FIG. 12, peaks 230 and 232 on all of the fingers are smoothly rounded so that there are no sharp points which might rupture the warp yarns of the fabric. In addition, the concave terminal portions of all the fingers are convexly rounded in a direction parallel to the longitudinal axis of the fabric as shown in FIG. 13.

With the arrangement described, finger plates 164 and 168 are positioned with edges 254 and 258, and 256 and 260, in alignment with one another. Therefore, all of the fingers on plate 164 are aligned with spaces between the fingers on plate 168. Likewise, all of the fingers on plate 168 are aligned with the spaces between fingers on plate 164.

Figure 14:
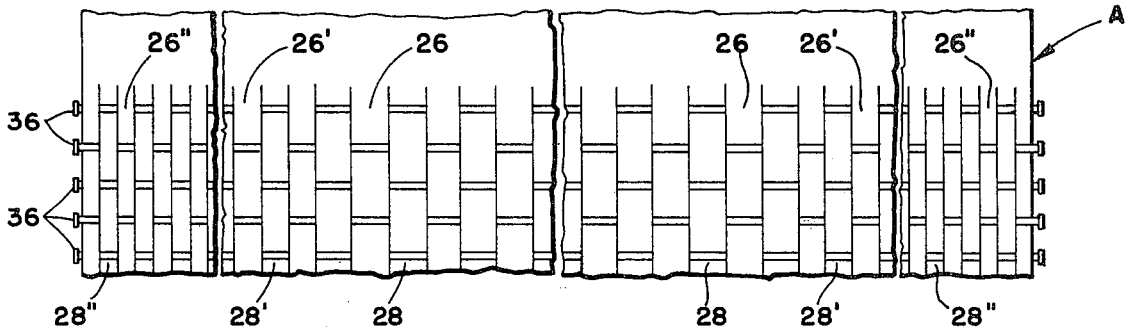
FIG. 14 is a top plan view of a splice made with the finger plates of FIGS. 10 and 11.

The described finger plates make a fabric splice A as shown in FIG. 14. A plurality of central partial loops 26 and 28 have a width of around ¼ inch. A plurality of intermediate partial loops 26' and 28' have a width of around 3/16 inch. Terminal partial loops 26'' and 28'' have a width of around ⅛ inch. With such an arrangement, a very tight edge weave is formed at the opposite edge portions of the splice to prevent unravelling of the edge portions of the fabric, and to prevent displacement of rods 36. Thus, the splice preferably has a plurality of relatively wide central partial loops extending alternately in opposite directions; a plurality of narrower intermediate partial loops; and a plurality of terminal partial loops, substantially narrower than the central and intermediate partial loops.

Figure 17:
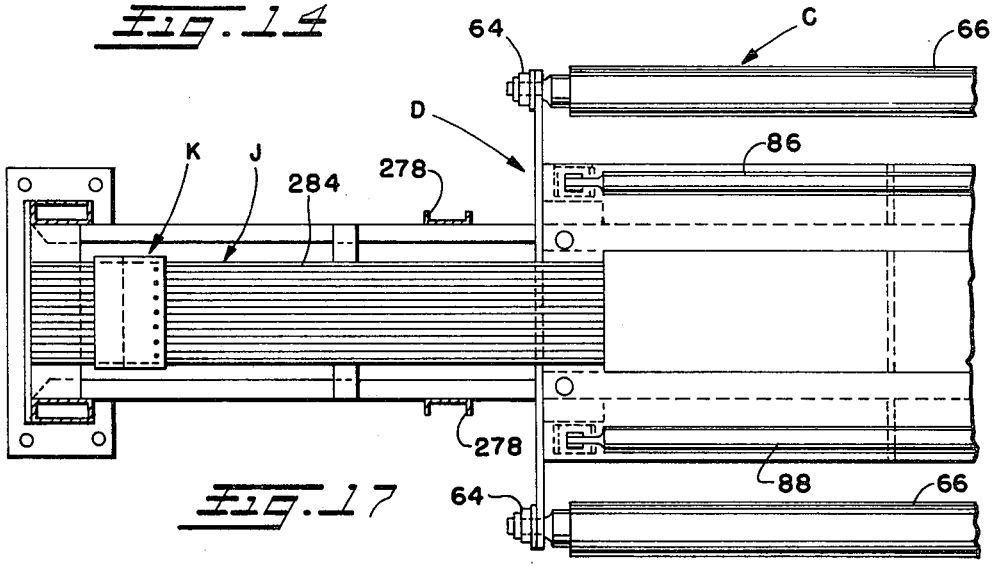
FIG. 17 is a cross-sectional plan view looking generally in the direction of arrows 17—17 of FIG. 16.
Figure 15:
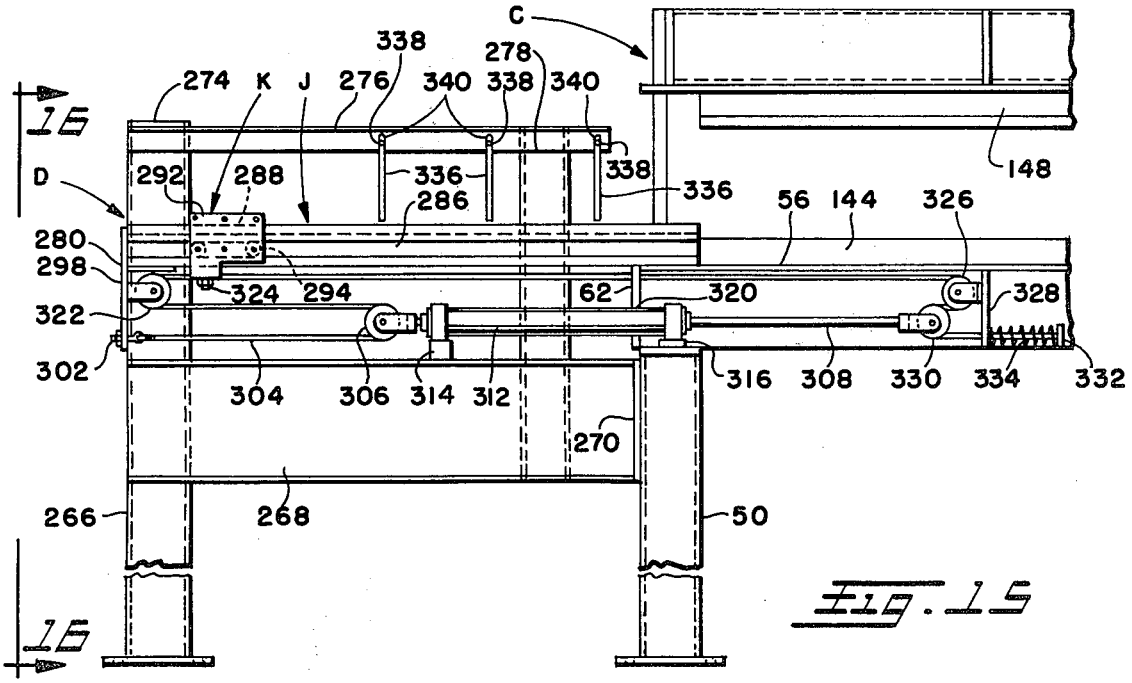
FIG. 15 is a cross-sectional elevational view looking generally in the direction of arrows 15—15 of FIG. 2.
Figure 16:
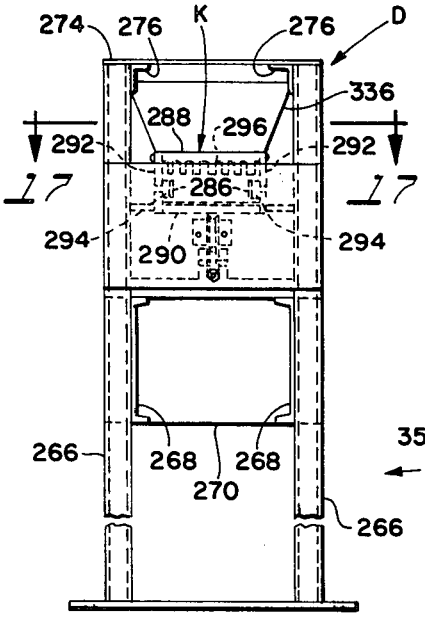
FIG. 16 is an end elevational view looking generally in the direction of arrows 16—16 of FIG. 15.

FIGS. 15–17 show details of rod inserting means D. Only one rod inserting means D will be shown and described in detail, and it will be recognized that the opposite rod inserting means D on the opposite side of splicer C is similarly constructed. Rod inserting means D includes a pair of spacedapart upright legs 266. A pair of horizontally extending channel beams 268 are welded or bolted to the inner surfaces of legs 266. The ends of beams 268 have a rectangular plate 270 welded thereto. Plate 270 is welded or bolted to legs 50 on splicer C.

The upper ends of legs 266 are connected by a connecting plate 274. Angle members 276 are welded to the inner surfaces of the upper end portions of legs 266 and extend substantially horizontally. Angle members 276 are welded to upright support members 278 which are welded to beams 268. An elongated guide support J has a plate 280 welded or bolted thereto and in turn welded to legs 266. The opposite end portion of guide support J may simply rest on an upper edge surface of plate 56 on splicer C, or may be welded or bolted thereto.

Guide support J has a plurality of longitudinally extending spaced-apart grooves 284 therein. In the arrangement shown, there are a total of seven grooves 284. However, any desirable number of grooves may be provided depending upon the number of rods 36 which are to be used for making a splice. The opposite side edges of guide support J have elongated grooves 286 therein.

A pusher member K has a generally hollow rectangular cross-sectional configuration as shown in FIG. 16. Pusher K includes top and bottom plates 288 and 290, and opposite side plates 292. Side plates 292 have a plurality of rotatable rollers 294 secured thereto and received in grooves 286 so that pusher member K may roll along guide support J. Top plate 288 on pusher K has a plurality of downwardly extending pusher fingers 296 thereon received in grooves 284.

A plate 298 welded to legs 266 has a fastener 302 for anchoring an end of chain or cable 304. Chain or cable 304 extends around pulley 306 on rod 308 of a double-acting double-ended cylinder 312 secured to a transverse support 314 welded across beams 268 and to a support 316 of splicer C. Cylinder 312 extends through hole 320 in roll support plate 62. Chain or cable 304 then extends around pulley 322 secured to plate 298. Chain or cable 304 is then secured to bottom plate 290 of pusher K by fastening device 324. Chain or cable 304 then extends around pulley 326 secured to a plate 328 on splicer C. Chain or cable 304 then extends around pulley 330 on the opposite end of cylinder rod 308. The other terminal end of chain or cable 304 is fixed to an anchoring device as at 332 on splicer C. A coil spring 334 may be provided to allow some movement of anchor 332 to prevent over-tensioning of chain or cable 304.

A plurality of guide plates 336 have generally inverted trapezoidal configurations. Plates 336 have rods 338 on the upper ends thereof received in vertically elongated holes 340 in angle members 276. Thus, plates 336 are free to pivot about axes extending substantially parallel to the longitudinal axis of the fabric going through splicer C. Plates 336 are also allowed slight vertical movement due to slightly elongated holes 340 in angle members 276.

In operation of the device, when a double layer of fabric is clamped and looped as shown in FIG. 7, cylinder 312 is energized so that pulleys 330 and 306 move to the left in FIG. 15. This causes chain or cable 304 to travel from left to right between pulleys 322 and 326 so that pusher K is shifted from left to right in FIG. 15. Elongated rods 36 previously positioned in grooves 284 are contacted by pusher fingers 296 and moved longitudinally across guide support J into the loops in the fabric double layer. Guide plates 336 maintain rods 36 substantially horizontal as they are moved into the loops. Without guide plates 336, or some other similar guide means, rods, 36 would be cantilevered too far out beyond the end of guide support J, and might not extend through all of the loops in the fabric double layer. For extremely wide fabric, rod inserting means D is provided on opposite sides of splicer C for inserting a pair of rods into each row of loops. The inner portions of the rods will overlap slightly at the longitidinal centerline of the fabric double layer. For smaller width fabrics, it is possible to use only one rod inserting apparatus. Once rods 36 are positioned in the loop rows, cylinder 312 is energized in the opposite direction to retract pusher K. With the arrangement of the present invention, it has been found possible to make a fabric splice of the type described in only around 3–5 seconds.

Figure 18:
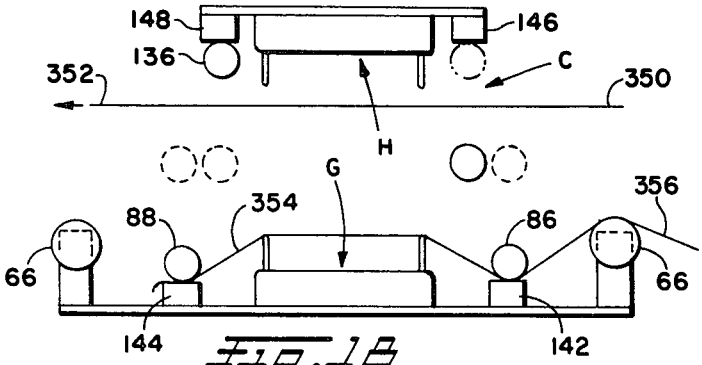
FIGS. 18 through 23 are diagrammatic side elevational views showing the sequence of operation of the improved splicing apparatus constructed in accordance with the present invention.
Figure 19:
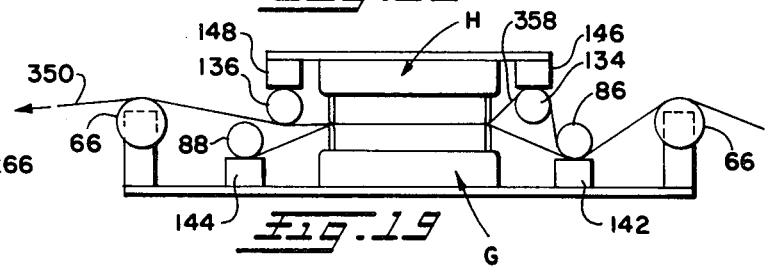
Figure 20:
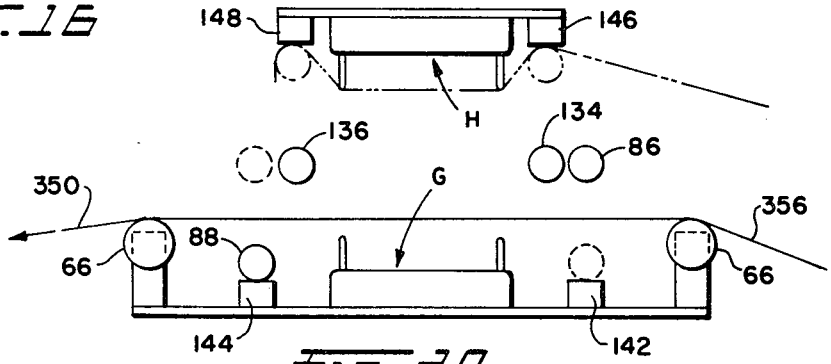

FIG. 18 shows flat fabric 350 travelling through splicer C in the direction of arrow 352. Fabric holding bar 134 had previously been extended so that fabric 350 is located between fabric holding bar 134 and holding member 146. A leading end portion 354 of additional fabric 356 is positioned across platen G and clamped by fabric holding bars 86 and 88 against fabric holding members 142 and 144. When tail end portion 358 of fabric 350 approaches splicer C, rolls 42 are stopped so that no more fabric is fed into storage accumulator E of FIG. 2. Holding bar 134 is then retracted to hold tail end portion 358 of fabric 350 against holding member 146 as shown in FIG. 18. Platen H is then moved toward platen G to form loops. Rod inserting means D is then operated to insert the rods in the loops. Holding bars 86, 88 and 134 are then extended a sufficient amount to free fabric end portions 354 and 358, while upper platen H is moved upwardly away from lower platen G to free the spliced fabric for travel in the direction of arrow 352. Fabric 356 is then travelling across rolls 66 as shown in FIG. 20.

Figure 21:
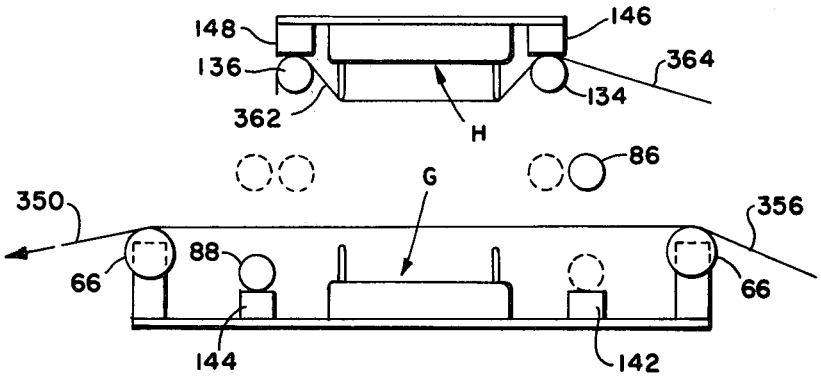
Figure 22:
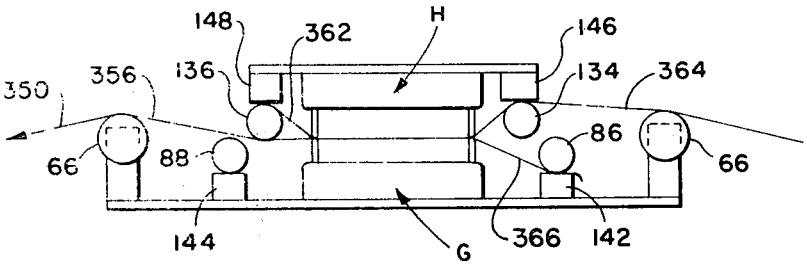
Figure 23:
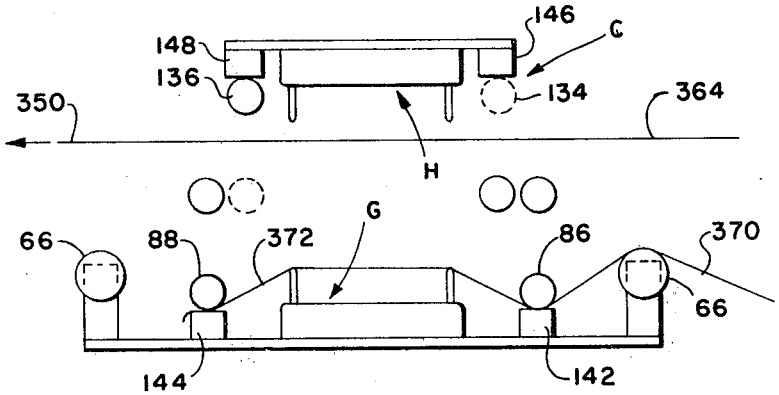

As fabric 356 travels through the treatment apparatus, leading end portion 362 of additional fabric 364 is positioned across upper platen H, and held by fabric holding bars 134 and 136 against holding members 146 and 148 in the manner shown in FIG. 21. When tail end portion 366 of fabric 356 approaches splicer C, rolls 42 are again stopped and holding bar 86 is retracted to clamp tail end portion 366 against holding member 142 in the manner shown in FIG. 22. Upper platen H is again moved toward lower platen G for making a splice in the manner previously described. Holding bars 86, 134 and 136 are then extended to free end portions 362 and 366, while upper platen H is moved away from platen G. Fabric 364 is then travelling through splicer C in the manner shown in FIG. 23. An additional fabric 370 has a leading end portion 372 held by holding bars 86 and 88 ready for splicing to the tail end portion of fabric 364. The procedural steps of FIGS. 18-23 may then be repeated for continuously splicing fabric together for processing.

Although the invention has been shown and described with respect to a preferred embodiment, it is obvious that equivalent alterations and modifications will occur to others skilled in the art upon the reading and understanding of this application. The present invention includes all such equivalent alterations and modifications, and is limited only by the scope of the claims.

The embodiments of the invention in which an exclusive property or privilege is claimed are defined as follows.

I claim:

1. A method of making a splice between contacting overlapped fabric end portions defining a fabric double layer having a longitudinal axis and a lapping plane, comprising the steps of; forming a plurality of transverse rows of loops in said double layer with each row including a plurality of partial loops extending alternately in opposite directions out of said plane transversely of said longitudinal axis, each said partial loop including the contacting fabric of both said overlapped fabric end portions, and inserting elongated substantially rigid rod means through said partial loops in each of said loop rows to hold said fabric end portions together.

2. The method of claim 1 wherein said step of forming said loops is carried out by forming a plurality of central partial loops having a predetermined width and a plurality of terminal loops adjacent the side edges of said fabric double layer having a width substantially less than said predetermined width.

3. The method of claim 2 wherein said step of forming said loops is carried out by forming a plurality of intermediate partial loops between said central and terminal partial loops having a width intermediate the widths of said central and terminal partial loops.

4. The method of claim 1 wherein prior to forming the plurality of transverse rows of loops in the fabric double layer, the double layer is transversely clamped in longitudinally spaced locations, and the loops are formed in the fabric double layer intermediate such longitudinally spaced locations.

5. The method of claim 1 wherein thhe elongated substantially rigid rod means are inserted into the loop rows from both sides of the fabric double layer, such rod means having a length slightly greater than one-half the width of the fabric double layer so that the inner end portions of the rod means overlap in each loop row near the central longitudinal axis of the fabric double layer.

6. The method of claim 1 wherein a plurality of such elongated substantially rigid rod means are simultaneously inserted into the loop rows from one side edge of the fabric double layer.

7. The method of claim 1 wherein a plurality of such elongated substantially rigid rod means are simultaneously inserted into the loop rows from both side edges of the fabric double layer.

8. The method of claim 1 wherein such loop rows are formed by moving at least one of a pair of opposed platens positioned on opposite sides platens, the double layer toward the other of the platens such platens including a plurality of spaced-apart pairs of spaced-apart partial loop forming fingers which overlap and form the loops in the double layer during movement of one of the platens toward the other as aforesaid.

9. The method of claim 8 wherein such platens have a plurality of slots therein receiving finger plates each having a plurality of such partial loop forming fingers thereon, such partial loop forming fingers on each of such finger plates including a plurality of central partial loop forming fingers of a predetermined width which form a plurality of central partial loops in the fabric double layer having a corresponding width, and a plurality of smaller terminal fingers on the opposite end portions of the finger plates which form a plurality of terminal partial loops in the fabric double layer adjacent the side edges thereof having a width substantially less than the width of the central partial loops.

10. The method of claim 9 wherein there are a plurality of intermediate partial loop forming fingers between the central and terminal fingers having a width intermediate the widths of the central and terminal fingers which form a plurality of intermediate partial loops in the fabric double layer during movement of at least one of the platens toward the other as aforesaid.

11. A method of splicing fabric with opposed platens each having a pair of individually extensible and retractable elongated transversely extending longitudinally-spaced holding bars positioned outwardly of loop forming platen fingers, comprising the steps of; holding a first fabric end portion beneath at least one of said holding bars on one of said platens with said first fabric end portion spanning said fingers, holding a second fabric end portion beneath at least one of said holding bars on the other of said platens with said second fabric end portion spanning said fingers on said other platen, moving at least one of said platens toward the other of said platens to overlap said first and second fabric end portions in a fabric double layer, continuing movement of said one platen toward said other platen to extend said fingers through said double layer in opposite directions and form transverse rows of loops in said double layer with each row having a plurality of oppositely extending partial loops transversely of said double layer, inserting elongated substantially rigid rods into said rows, releasing said first and second fabric end portions from beneath said certain holding bars, and moving said one platen away from said other platen.

* * * * *